US010926369B2

(12) United States Patent
Lea

(10) Patent No.: US 10,926,369 B2
(45) Date of Patent: Feb. 23, 2021

(54) ADJUSTABLE TOOL SHARPENING PLATFORM

(71) Applicant: Gilbert Melbye Lea, West Des Moines, IA (US)

(72) Inventor: Gilbert Melbye Lea, West Des Moines, IA (US)

( * ) Notice: Subject to any disclaimer, the term of this patent is extended or adjusted under 35 U.S.C. 154(b) by 0 days.

(21) Appl. No.: 15/929,332

(22) Filed: Apr. 27, 2020

(65) Prior Publication Data

US 2020/0338681 A1 Oct. 29, 2020

Related U.S. Application Data

(60) Provisional application No. 62/838,383, filed on Apr. 25, 2019.

(51) Int. Cl.
*B24B 3/36* (2006.01)
*B24B 51/00* (2006.01)

(52) U.S. Cl.
CPC ..... *B24B 3/36* (2013.01); *B24B 51/00* (2013.01)

(58) Field of Classification Search
CPC ..... B24B 3/36; B24B 51/00; B24B 3/245; B24B 3/40; B24B 23/028; B24B 21/00; B24B 9/0027; B24B 27/0084; B24B 19/002; B24B 41/06; B24D 15/06
See application file for complete search history.

(56) References Cited

U.S. PATENT DOCUMENTS

| | | | | |
|---|---|---|---|---|
| 3,660,947 | A | 5/1972 | Clark, Jr. | |
| 4,115,956 | A | 9/1978 | Huffman | |
| 4,443,975 | A | 4/1984 | German et al. | |
| 4,460,275 | A | 7/1984 | Spriggs | |
| 4,630,214 | A | 12/1986 | Barney et al. | |
| 4,643,622 | A | 2/1987 | Winski | |
| 5,006,685 | A | 4/1991 | Hatano et al. | |
| 5,168,661 | A | 12/1992 | Pedersen et al. | |
| 5,662,514 | A | 9/1997 | Masseth et al. | |
| 6,739,943 | B2 | 5/2004 | Wirz | |
| 6,865,787 | B2 | 3/2005 | Shingai et al. | |
| 6,926,596 | B1 * | 8/2005 | Tarris | B24B 3/38 451/367 |
| 7,387,562 | B1 * | 6/2008 | Blum | B24D 15/08 451/380 |
| 7,524,236 | B2 | 4/2009 | Schwaiger et al. | |
| 7,797,074 | B2 | 9/2010 | Hyatt et al. | |
| 8,098,038 | B2 | 1/2012 | Okita et al. | |
| 8,197,304 | B2 * | 6/2012 | Hummel | B24B 3/34 451/45 |
| 9,272,385 | B2 | 3/2016 | Guo et al. | |
| 9,751,182 | B1 | 9/2017 | Warne | |
| 2010/0203808 | A1 * | 8/2010 | Hout | B24B 3/38 451/28 |
| 2010/0248594 | A1 | 9/2010 | Nish | |

* cited by examiner

*Primary Examiner* — Dung Van Nguyen
(74) *Attorney, Agent, or Firm* — Dunlap Bennett & Ludwig, PLLC

(57) ABSTRACT

A one or more assemblies embodying a repeatable and programmable tool platform for enabling a method for performing programmatically repeatable tool sharpening techniques. The present invention uses adjustable lifters for securing and repeating tool sharpening angles.

4 Claims, 5 Drawing Sheets

ADJUSTABLE TOOL SHARPENING PLATFORM

CROSS-REFERENCE TO RELATED APPLICATION

This application claims the benefit of priority of U.S. provisional application No. 62/838,383, filed 25 Apr. 2019, the contents of which are herein incorporated by reference.

BACKGROUND OF THE INVENTION

The present invention relates to sharpening tools and, more particularly, to an adjustable tool sharpening platform.

When sharpening lathe tools, it is important to maintain the correct angle for each specific tool each time it is sharpened. Frequent and accurate sharpening helps make cutting tools safer and cut smoother. Exact and repeatable sharpening saves time, eliminates wasteful grinding on tools that can be expensive, and helps the user sharpen more frequently by making it fast and easy. Freehand sharpening cannot do this. With most tool rests, a user approximates a grinding angle, tightens a locking knob, makes a test grind, readjusts, and tries again, and maybe again. As an iterative process, this approach is not immediately repeatable. Few if any current tool sharpening devices are repeatable, and none are programmable and repeatable.

As can be seen, there is a need for an adjustable tool sharpening platform that is programmatically repeatable.

SUMMARY OF THE INVENTION

In one aspect of the present invention, apparatus includes the following: a platform extending between a distal end and a proximal end; a frame extending between a first end to a second end; the proximal end pivotably connected to the first end; a channel connected along an underside of the distal end; a pivot rod mounted downward of the channel; a plurality of lifting rods rotatably connected about a longitudinal axis of the pivot rod; and each lifting rod movable linearly in an orthogonally relationship to the pivot rod in such a way that a distal end of each lifting rod engages the channel for setting an angle of incidents between the platform and the frame.

In another aspect of the present invention the apparatus further includes the frame providing a first frame and a second frame pivotably connected to each other, and wherein the first frame provides the first end; a pivot block operatively associated with each lifting rod and the pivot rod, wherein each pivot block has an identification indicia; and a lock nut associated with each lifting rod for selectively moving each lifting rod between an unlock condition and a lock condition programmatically setting said distal end of each lifting rod at a distance above the pivot rod.

In yet another aspect of the present invention, the apparatus includes the following: a platform extending between a distal end and a proximal end; a frame extending between a first end to a second end; the proximal end pivotably connected to the first end; a first pivotable connection disposed along an underside of the distal end, the first pivotable connection pivots in a first direction; a second pivotable connection disposed along an underside of the distal end, the second pivotable connection pivots in a second direction; a face plate connected to the frame downward of the platform; a plurality of holes spaced apart along the face plate; and a lifting rod operatively associated with the first pivotable connection and second pivotable connections in such a way so as to selectively engage one of the plurality of holes for setting an angle of incidents between the platform and the frame.

In yet another aspect of the present invention, a repeatable and programmable tool platform includes the following: a platform extending between a distal end and a proximal end; a frame pivotably connected to said proximal end; and a plurality of lifting rods rotatably connected to a lower portion of the frame in such a way that each lifting rod selectively engages said proximal end for setting an angle of incidents between the platform and the frame.

These and other features, aspects and advantages of the present invention will become better understood with reference to the following drawings, description and claims.

DETAILED DESCRIPTION OF THE INVENTION

Figure 1:
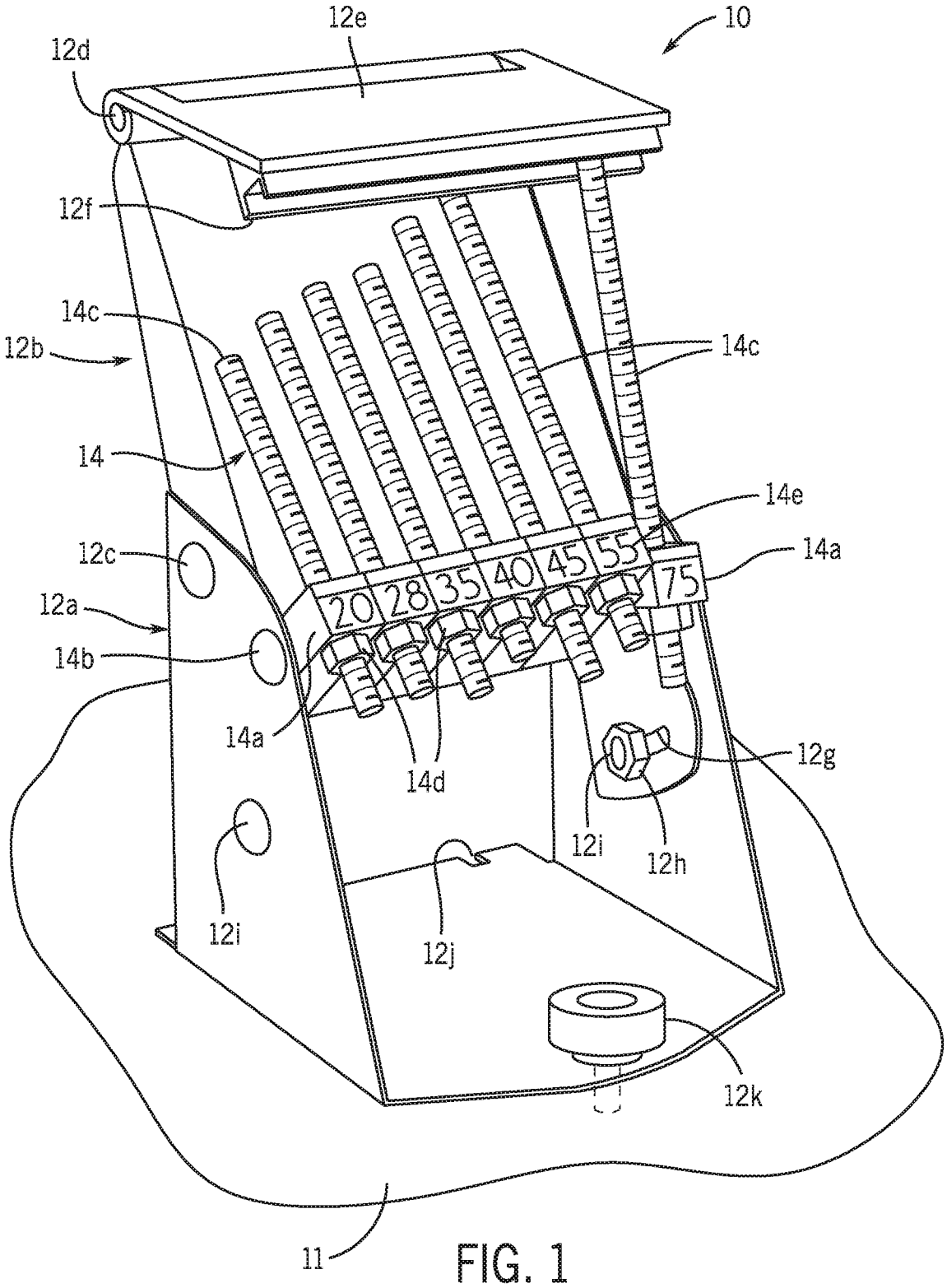
FIG. 1 is a front perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a one or more assemblies embodying a repeatable and programmable tool platform for enabling a method for performing programmatically repeatable tool sharpening techniques. The present invention uses adjustable lifters for securing and repeating tool sharpening angles.

Referring to FIGS. 1 through 3B, the present invention may include a first assembly 10 having the following components:

1. 12*e* PLATFORM: A cutting tool 16 may be placed on an upper surface thereof to be supported at the proper angle for grinding. The platform 12*e* extends from a proximal end to a distal end.

2. 12*d* PIVOTABLE CONNECTION: Pivotably connects the proximal end of platform 12*e* to an upper frame 12*b* for selectively adjusting (e.g., tilting, pivoting, etc.) the platform 12*e* relative to the upper frame 12*b*, thereby enabling the repeatable setting of an adjustable angle of incident between a supporting surface 11 and the platform 12*e*.

3. 12*f* CHANNEL: Provided along an underside of the distal end of the platform 12*e*. The channel 12*f* is dimensioned and adapted to operatively associate with one or a plurality of adjustable lifters 14, thereby selectively propping the platform 12*e* at a selectable angle of incidence.

4. 14 ADJUSTABLE LIFTERS: Each adjustable lifter 14 may include a pivot block assembly 14*a* operatively associated with a threaded rod 14*c*, wherein the threaded rod 14*c* can be lengthened or shortened relative to the pivot block assembly 14*a* by twisting the threaded rod 14*c*. Each adjustable lifter 14 represents an angle of incidence settable by the user, then locked in place for future, repeatable uses.

5. 12*b* UPPER FRAME: Supports the platform pivot connection 12*d* and is connected to a lower frame 12*a* by fasteners 12*c*.

Figure 3A:
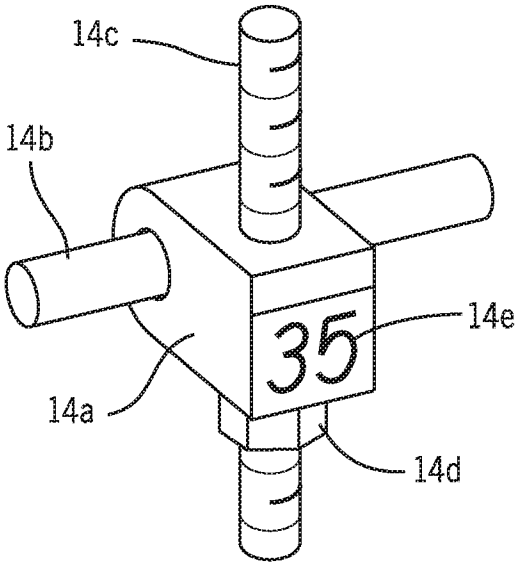
FIG. 3A is a detailed perspective view of an exemplary embodiment of the present invention, illustrating a pivot block 14*a;*
Figure 3B:
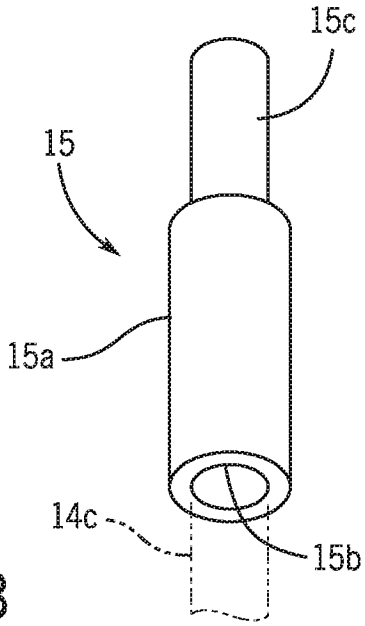
FIG. 3B is a detailed perspective view of an exemplary embodiment of the present invention, illustrating a lifter extender 15 to increase the length of a threaded rod 14*c* and by extension the range of degrees that the platform 12*e* can swing. Each lifter extender has a body 15*a* with a protrusion 15*c* for associating with the channel 12*f* when the lifter extender 15 engages a distal end of the threaded rod 14*c* by way of a threaded hole 15*b* in the body 15*a;*
Figure 3:
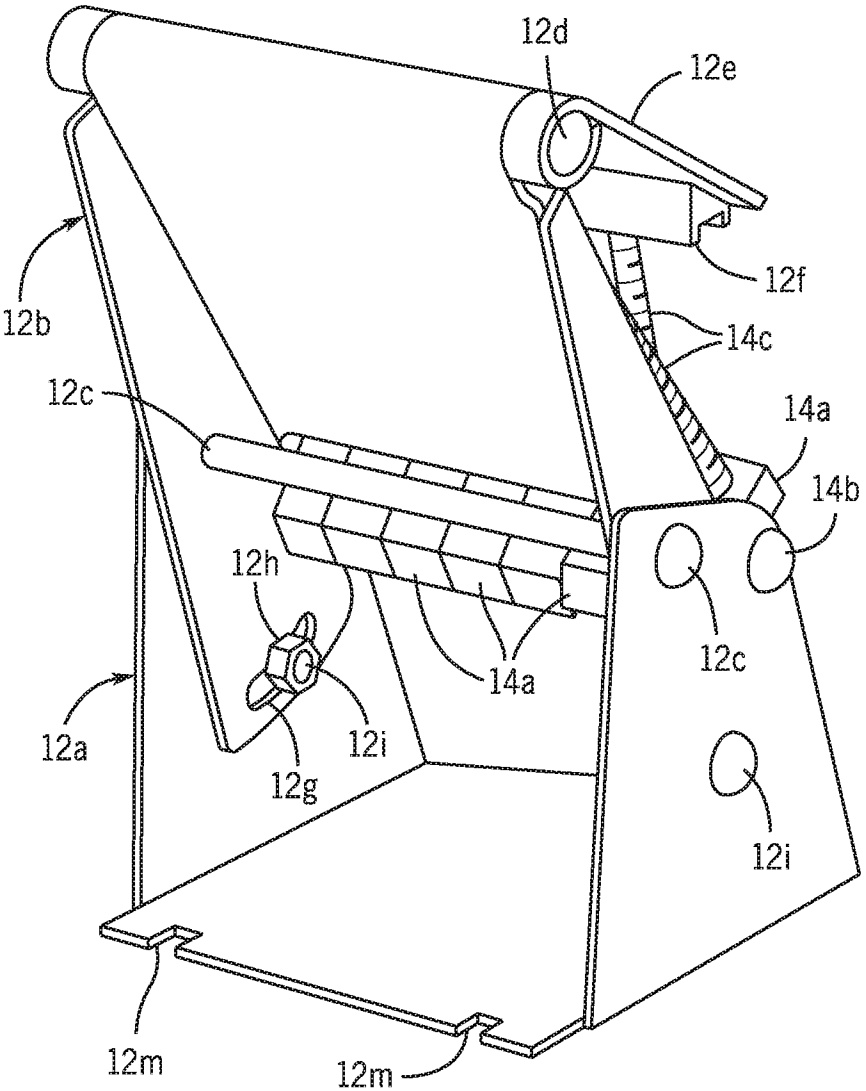
FIG. 3 is a rear perspective view of an exemplary embodiment of the present invention.

6. 14*a* PIVOT BLOCKS: A plurality of pivot blocks 14*a* are pivotably connected to a pivot attachment 14*b*. The pivot attachment 14*b* may be supported by the lower frame 12*a*; in certain embodiments, the pivot attachment 14*b* extends between opposing sides of the lower frame 12*a*. The pivot attachment 1*b* may generally be disposed downward of the channel 12*f* with space above and below the pivot attachment 14*b* to allow for the adjustable movement of the associated threaded rods 14*c* through their pivot blocks 14*a*. Each pivot block 14*a* may provide a pivot hole for receiving and freely rotating about the pivot attachment 12*b*, as illustrated in FIG. 3A. Each pivot block 14*a* may provide a threaded hole to operatively associate with a threaded rod 14*c* so that by rotating the threaded rod 14*c* (screwing/unscrewing) moves the threaded rod 14*c* upward or downward relative to the pivot block 14*a* and the associated pivot attachment 14*b*, to which the pivot block 14*a* is linear fixed.

A locking element 14*d* (such as a nut) may couple to the threaded rod 14*c* for forming a locking engagement that prevents the threaded rod 14*c* from moving screwing/unscrewing (moving linearly) as disclosed above. This locks the threaded rod to the chosen length so it can be repeated every time it is needed.

Each pivot block 14*a* may provide an identification indicia 14*e* for visibly identifying one pivot block 14*a* among the plurality of pivot blocks 14*a*.

Each threaded rod 14*c* can swing outward (forward) to engage the channel 12*f* and swing backward out of the way of the channel 12*f* within the above-mentioned space when not in use. The upper frame 12*b* may taper backward as it extends upwardly toward the pivotable connection 20*d* for accommodating the unused threaded rods 14*c*.

Figure 2:
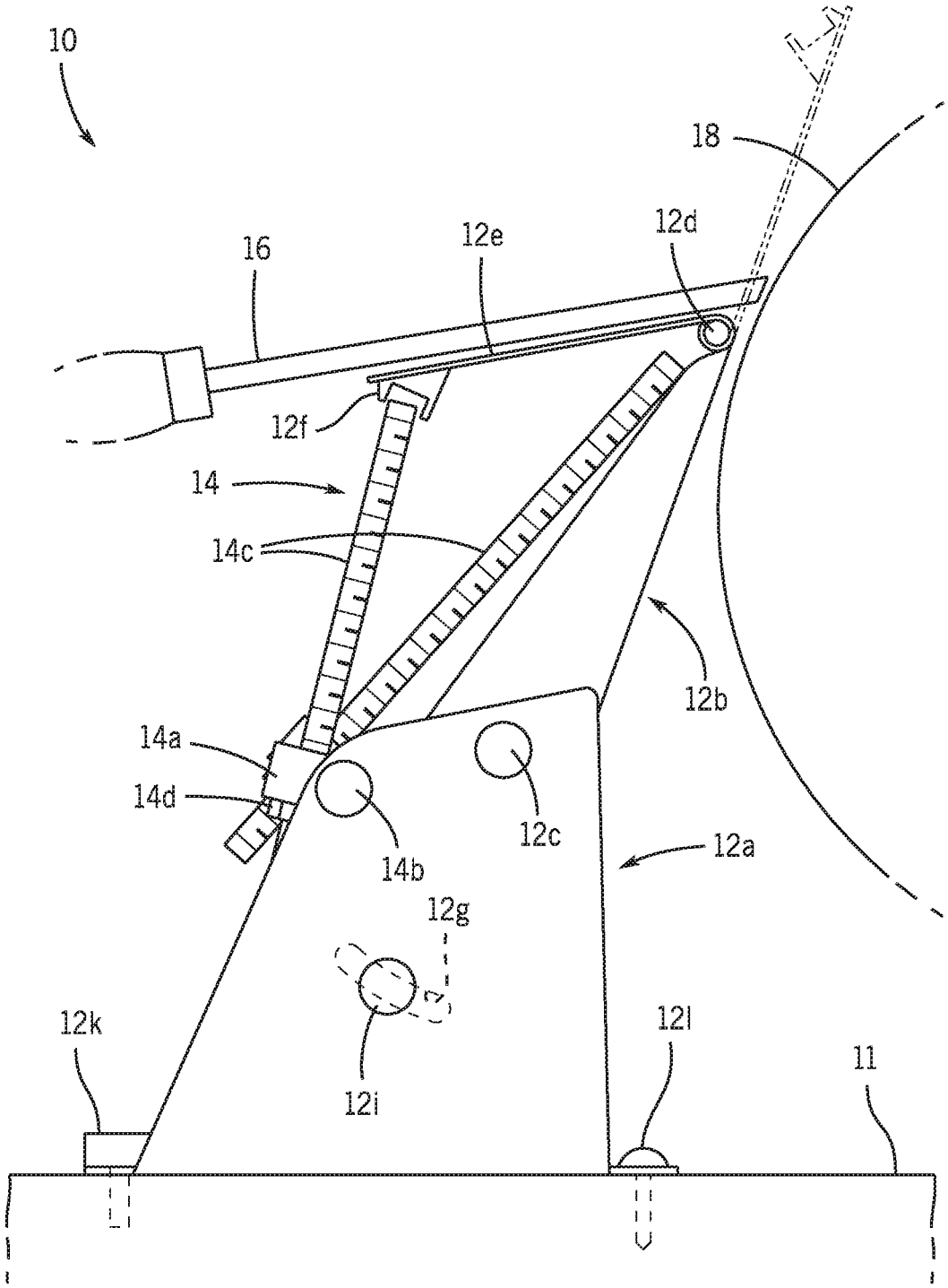
FIG. 2 is a side elevation view of an exemplary embodiment of the present invention, shown in use.

9. 12*g* TILT ADJUSTMENT SLOT: The tilt adjustment slots 12*g* along sidewalls of the lower and upper frames 12*a* and 12*b* enable the upper frame 12*b* to pivot relative to the lower frame 12*a* for further facilitating the operative association of the channel 12*f* and the threaded rods 14*c* while also providing sufficient space for the threaded rods 14*c* that are not in use as well as providing adequate clearance between the platform 12*e* and the grinding wheel 18, as illustrated in FIG. 2. It can also give the user a selection of preferences in adjusting the working range. Slot fasteners 12*i* and 12*h* may be used to form the slotted pivoting described above.

11. 12*j* HOLD-DOWN SLOT: The hold-down slots 12*j* on the bottom rear of the lower frame 12*a* engage the base 11/workbench by way of removable fasteners 12*l*. This allows for fast, easy removal of the apparatus 10 so the grinding wheel 18 can be used for other purposes, then easily and accurately reinstalled.

12. 12*k* ANCHOR KNOB: This knob locks the lower frame 12*a* into a supporting surface 11, such as a workbench.

Figure 4:
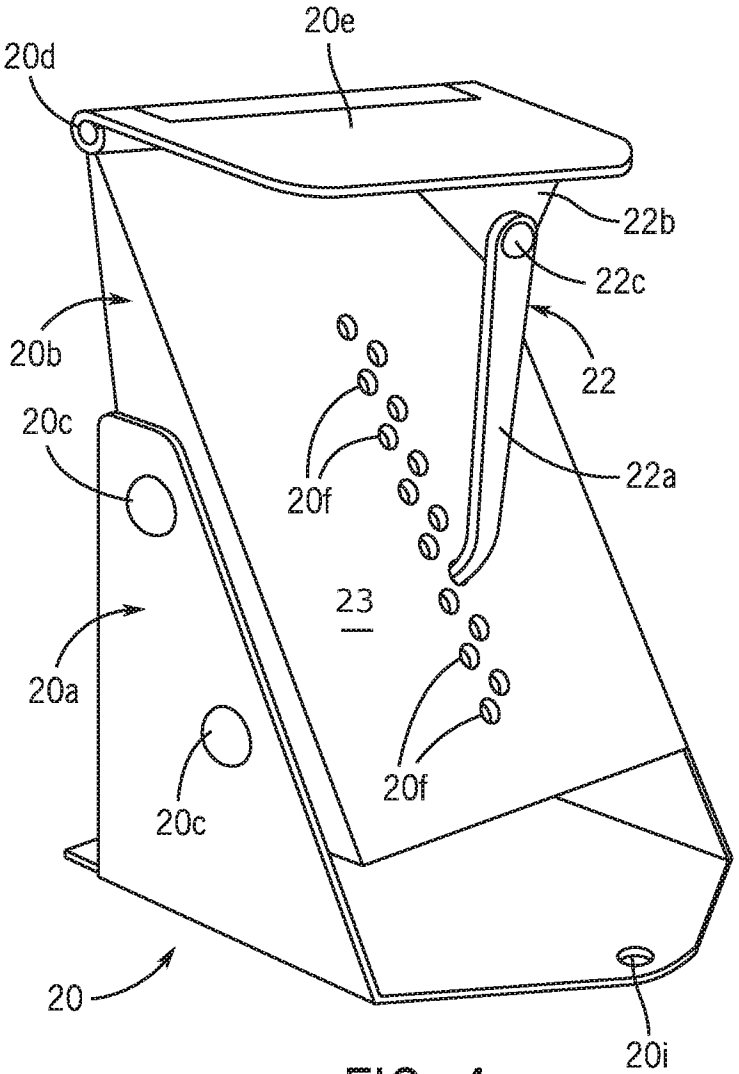
FIG. 4 is a front perspective view of an exemplary second embodiment of the present invention.
Figure 6:
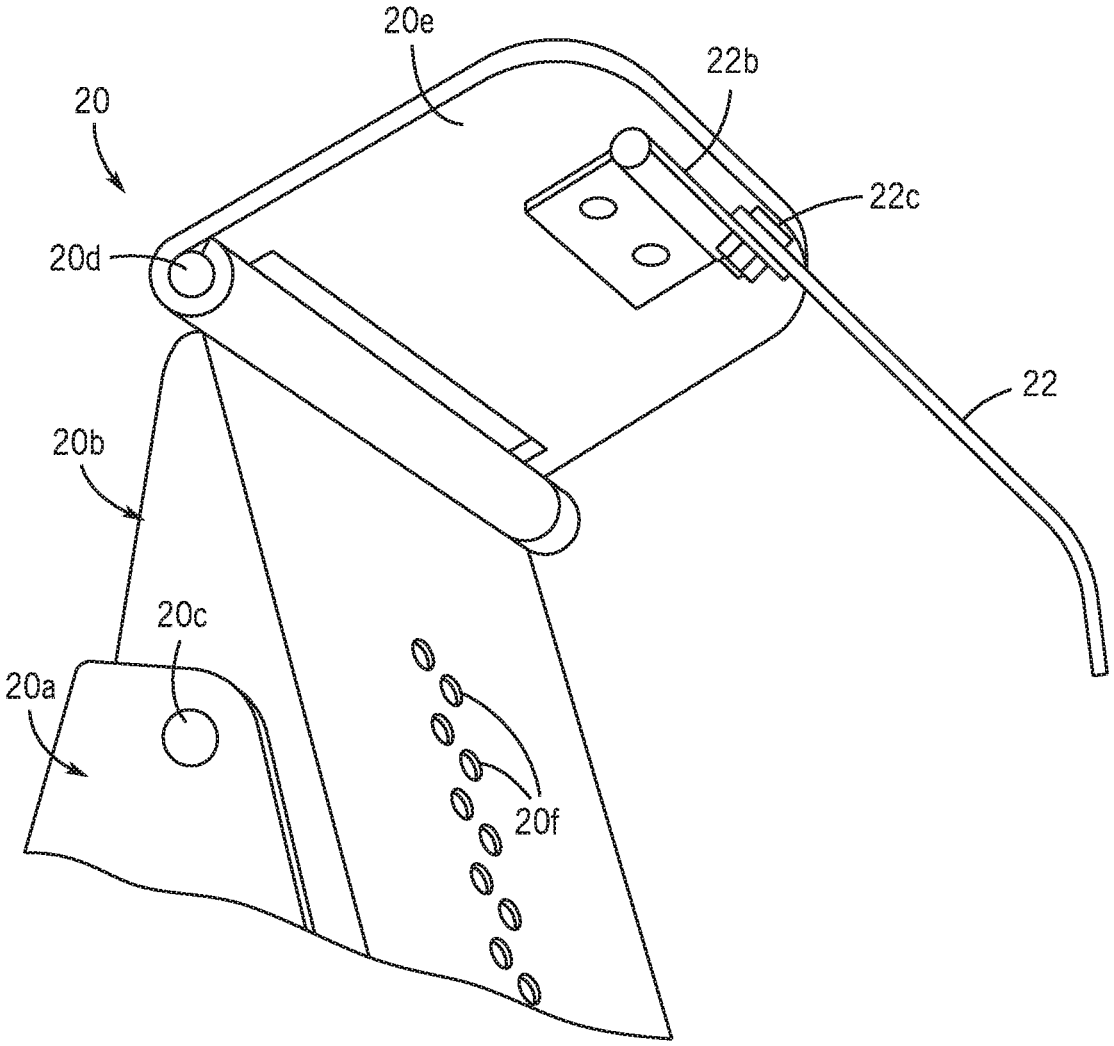
FIG. 6 is a bottom perspective view of an exemplary second embodiment of the present invention.

It should be understood by those skilled in the art that the use of directional terms such as upper, lower, upward, downward, forward, rearward, underside and the like are used in relation to the illustrative embodiments as they are depicted in the figures, the upward direction (or upper) being toward the top of FIGS. 1, 2 and 4, for their respective apparatuses, while the forward direction being understood as toward the left of FIG. 2 but toward the right in FIG. 6.

The upper frame 12*b* holds one side of the platform and an adjustable lifter 14 holds the opposite side of the platform 12*e*. The adjustable lifter 14 engages with a channel 12*f* under the platform 12*e*, keeping the selected adjustable lifter 14 in place. The pivot block 14*a* on the pivot attachment 14*b*, allows the threaded rod 14*c* to swing forward into use. The pivot block 14*a* also allows the threaded rod 14*c* to lengthen or shorten by being twisted, to be set for the proper tilt of the platform 12*e*. A locking element 14*d* under each pivot block 14*a* ensures that the programmed angle can be repeated exactly. There are many types of tools 16, each with its own grinding angle requirements. Resharpening is done by recalling the appropriate angle for the tool 16 being sharpened.

Once an angle for a particular tool 16 is set, it is noted by associating that tool with the color code of the chosen adjustable lifter 14 or by associating that tool with the angle the user wrote on that adjustable lifter 14 by way of the identifiable indicia 14*e* on the pivot block 14*a*, wherein certain embodiments, is a white space on is face for the user to write the degree of that angle. The user can match the tool 16 with the color code or with the degree marking on that lifter. There are multiple adjustable lifters 14 for a variety of tool types. For example, one tool 16 may require the lifter marked 40 (for 40 degrees), which may be green. Another requires a 25-degree angle (blue) and another at 55 degrees, (orange). Each lifter can be assigned its own angle and locked there with the locking element 14*d* so that a user never need search for it again. There may be several tools 16 that use the same adjustable lifter 14 (i.e. the same angle).

Different tools require different grinding angles to cut properly. You choose the associated adjustable lifter 14, pull it forward to engage into the channel 12*f* under the unhinged side of the platform 12*e*. Then adjust the threaded rod 14*c* by rotating it to make it longer or shorter, raising or lowering the edge of the platform 12*e* until the desired sharpening angle is found. Then lock it in place using the locking element 14*d* for quick, accurate repetition of that angle every time it is needed from then on. Each adjustable lifter 14 can be set for a different angle of incidence.

This tool rest provides exact repeatability and precise programming, especially useful when switching back and forth between tools 16 requiring different grinding angles. To return the platform 12*e* to any previously programmed angle, simply place the appropriate adjustable lifter 14 into the channel 12*f*, place the tool 16 on the platform 12*e* and grind.

Figure 5:
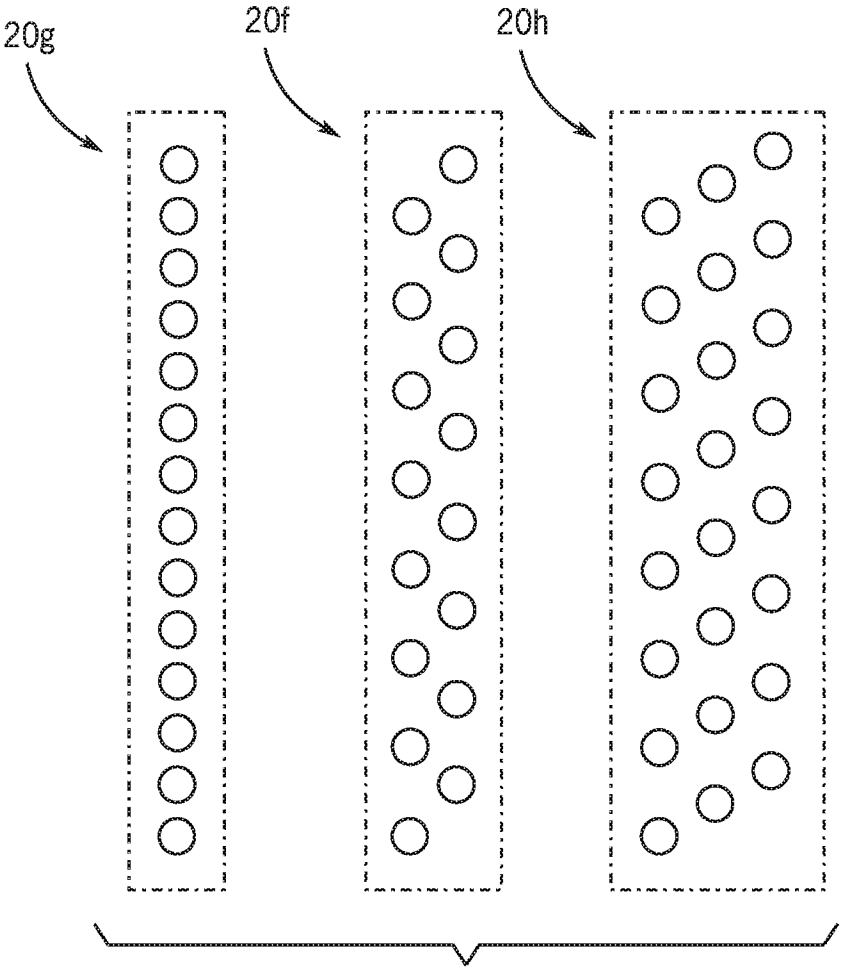
FIG. 5 are detailed front elevation views of exemplary embodiments of arrangement of holes along an operable surface 23.

Referring to FIG. 4 through 6, the present invention may include an alternative apparatus 20. Apparatus 20 may include the following components:

1. 20*e* PLATFORM: Cutting tool 16 may be placed on an upper surface to be supported at the proper angle for grinding.

2. 20*d* PIVOTABLE CONNECTION: Allows the platform 20*e* to adjustably tilt and selectively be set relative to an upper frame 20*b*.

3. 20*b* UPPER FRAME: Supports the platform 20*e* and pivotable connection 20*d*.

4. 22 HANGING LIFTER: The hanging lifter 22 includes a hanging rod 22*a* that depends from the underside of the platform 20*e* by way of a first pivotable connection 22*b* and a second pivotable connection 22*c*. The first pivotable connection 22*b* enables the hanging rod 22*a* to swing forward and rearward, while the second pivotable connection enables the hanging rod 22*a* to swing or post swings freely laterally towards to sides of the apparatus 20. This bidirectional-pivotable assembly, operable along two orthogonal planes/axis, enables a distal end of the hanging rod 22*a* to operatively associate with one of a range of holes 20*f* along an operable surface 23 the upper frame 20*b*. The operable surface 23 may tilt rearward (toward the upper left-hand corner of FIG. 4) as it extends from a lower end to an upper end engaging the pivotable connection 20*b*. Different hole arrangements 20*f*, 20*g*, and 20*h*, as illustrated in FIG. 5, allow for different tilts of the platform 20*e*. Different holes 20*f* allow for different tilts of the platform 20*e*. Each hole 20*f* may have a reference number.

6. 20*a* LOWER FRAME: Holds the upper frame 20*b* (and by extension the operable surface 23) with removably fasteners 20*c*. The lower and upper frames 20*a* and 20*b* may have tilt adjustment slots (not shown in FIGS. 4-6) similar to apparatus 10, thereby allowing user preference for the tilt of the upper frame 20*b*.

7. 20*i* ANCHOR HOLE: secures or mounts the apparatus 20 rest to a workbench or base.

A frames 20*b* and 20*a* holds one side of the platform 20*e* and a hanging lifter 22 holds the opposite side of the platform 20*e*. The hanging lifter 22 engages with holes in the face plate/operable surface 23. The choice of holes 20*f* can raise or lower the unhinged edge of the platform 20*e*, increasing or decreasing the angle of the platform. This method uses increments (method A does not). To sharpen a variety of tools 16 requiring different grinding angles, a tiltable platform 20*e* on a pivotable connection 20*d* can be set to the chosen angle by placing the hanging lifter 22 into the proper elevation hole 20*f*. Each hole 20*f* is numbered for repeatability. The first time a tool 16 is sharpened, different holes 20*f* are tested to find the closest match. The increments can be as small as necessary, but degrees (two rows) works well.

A method of using the present invention may include the following. The initial use involves selecting the approximate angles on the platform, then adjusting up or down as needed for the exact angle. This is done by rotating the lifter rod longer or shorter as needed. Then lock the lifter for that elevation using a locking element. At that time the user can note that angle for future use by writing the angle on the white space provided on the lifter. Alternatively, the user can just note the color code on that lifter for that tool. This tool rests can be used for sharpening a plurality of other types of tools, such as axes, chisels, knives, scissors and mower blades.

A method of making the present invention may include the following. A hinged platform could be supported by a metal or other sturdy material, even a block of wood, attached to a workbench. The part of the platform nearest the grinding wheel is hinged. The opposite side of the platform (nearest to the user), can be raised or lowered and selectively retained by an adjustable lifter to provide the desired grinding angle. Apparatus 10 is made by bending and bolting two pieces of heavy sheet metal together to hold the hinge and an assortment of lifters. A channel is formed under the unhinged edge of the platform to keep the chosen lifter in place. Apparatus 20 uses a metal bracket to hold the hinge to an inclined metal plate. Using holes, one above the other as close together as necessary to provide the adequate number of options for different grinding angles. A hanging apostate or lifter is hinged, hanging from the movable side of the platform. The lower end of the lifter has a point that engages with any one of a variety of the holes in the sheet metal. Smaller increments can be available by using more holes, in rows slightly staggered. The platform could be tilted from the grinder side or from the user side. The lifter could have notches, indents or holes to provide the choice of angles.

It should be understood, of course, that the foregoing relates to exemplary embodiments of the invention and that modifications may be made without departing from the spirit and scope of the invention as set forth in the following claims.

What is claimed is:

1. An apparatus, comprising:

a platform extending between a distal end and a proximal end;

a frame extending between a first end to a second end;

the proximal end pivotably connected to the first end;

a channel connected along an underside of the distal end;

a pivot rod mounted downward of the channel;

a plurality of lifting rods rotatably connected about a longitudinal axis of the pivot rod; and each lifting rod movable linearly in an orthogonally relationship to the pivot rod in such a way that a distal end of each lifting rod engages the channel for setting an angle of incidents between the platform and the frame.

2. The apparatus of claim 1, wherein the frame comprises a first frame and a second frame pivotably connected to each other, and wherein the first frame provides the first end.

3. The apparatus of claim 1, further comprising a pivot block operatively associated with each lifting rod and the pivot rod, wherein each pivot block has an identification indicia.

4. The apparatus of claim 1, further comprising a lock nut associated with each lifting rod for selectively moving each lifting rod between an unlock condition and a lock condition programmatically setting said distal end of each lifting rod at a distance above the pivot rod.

* * * * *